US007056006B2

(12) United States Patent
Smith

(10) Patent No.: US 7,056,006 B2
(45) Date of Patent: Jun. 6, 2006

(54) NIGHTLIGHT WITH INTERCHANGEABLE ROTATING DESIGN DISK

(75) Inventor: Steven W. Smith, Dallas, TX (US)

(73) Assignee: SWS Development, L.L.C., Dallas, TX (US)

( * ) Notice: Subject to any disclaimer, the term of this patent is extended or adjusted under 35 U.S.C. 154(b) by 154 days.

(21) Appl. No.: 10/720,463

(22) Filed: Nov. 24, 2003

(65) Prior Publication Data

US 2005/0111213 A1 May 26, 2005

(51) Int. Cl.
*H01R 33/00* (2006.01)

(52) U.S. Cl. ..... 362/644; 362/641

(58) Field of Classification Search ..... 362/125, 362/35, 269, 295, 806, 641, 644, 653, 811, 362/253, 311, 271, 322, 351; 40/429–435; 446/242

See application file for complete search history.

(56) References Cited

U.S. PATENT DOCUMENTS

| | | | | |
|---|---|---|---|---|
| 3,028,482 | A * | 4/1962 | Koehler | 40/433 |
| 3,030,944 | A * | 4/1962 | Blau et al. | 600/558 |
| 3,080,474 | A * | 3/1963 | Allen | 40/433 |
| 3,393,310 | A | 7/1968 | Ream | |
| 3,762,082 | A * | 10/1973 | Mincy | 40/433 |
| 4,073,598 | A * | 2/1978 | Mizutani et al. | 416/5 |
| 4,402,649 | A * | 9/1983 | Laurel | 416/5 |
| 4,491,772 | A * | 1/1985 | Bitting | 318/254 |
| 5,706,594 | A * | 1/1998 | Lin | 40/406 |
| 5,772,314 | A * | 6/1998 | Brumer | 362/360 |
| 6,267,478 | B1 * | 7/2001 | Chen | 353/84 |
| 6,449,887 | B1 * | 9/2002 | Song | 40/406 |
| 6,499,853 | B1 * | 12/2002 | Stekelenburg | 362/84 |
| 6,513,951 | B1 * | 2/2003 | Wang et al. | 362/253 |
| 6,572,245 | B1 | 6/2003 | Stekelenburg | |
| 6,592,423 | B1 * | 7/2003 | Boyle et al. | 446/175 |

FOREIGN PATENT DOCUMENTS

CH 673517 A5 * 3/1990

* cited by examiner

*Primary Examiner*—John Anthony Ward
*Assistant Examiner*—Robert May

(57) ABSTRACT

A nightlight with an interchangeable design disk mounted on the front thereof. A casing has an illumination area in a front side thereof, and a light bulb illuminates the illumination area from within. The nightlight also includes an electric motor mounted in the casing that has a shaft that extends through the front side of the casing proximate to the illumination area. The design disk mounts on the shaft and rotates with the shaft when the motor is energized. The design disk has a diameter that causes the disk to cover the illumination area in the front side of the casing when the disk is mounted on the shaft. The design disk has a design thereon that is visible when viewed from the front side of the nightlight when the light bulb shines through the disk from the illumination area in the front side of the casing.

18 Claims, 3 Drawing Sheets

NIGHTLIGHT WITH INTERCHANGEABLE ROTATING DESIGN DISK

BACKGROUND OF THE INVENTION

1. Technical Field of the Invention

This invention relates to nightlights. More particularly, and not by way of limitation, the present invention is directed to a nightlight having an interchangeable rotating design disk through which the light bulb of the nightlight shines.

2. Description of Related Art

People have used nightlights for a number of years to provide a low level of illumination to a room or hallway during nighttime hours. Over the years, nightlights have been sold with different decorative covers that are illuminated by the light bulb of the nightlight. For example, at Christmas time, nightlights have been sold with covers designed to look like Santa Claus. For children's rooms, nightlights have been sold with covers designed to look like comic or movie characters. However, these prior art nightlights did not have a movable image, or a changeable image.

In U.S. Pat. No. 6,572,245 to Stekelenburg, a nightlight with a dynamic image effect is disclosed. However, the nightlight requires a vertical light tube and a cylindrical cover, which rotates around the light tube to provide a moving image effect. However, this configuration requires significant complexity to cause the cylindrical cover to rotate around the stationary central light tube. Stekelenburg further discloses that the image may be formed by adhering an image film to the cylindrical cover, and that the image may be changed by removing and replacing the image film that is adhered to the cover. This is a cumbersome and difficult task, especially for children.

SUMMARY OF THE INVENTION

In order to overcome the disadvantage of existing solutions, it would be advantageous to have a nightlight with a simple design that is inexpensive to manufacture, and that has a moving image that is easily interchangeable. The present invention provides such a nightlight.

In one aspect, the present invention is directed to a nightlight that includes illuminating means; means for energizing the illuminating means; means for interposing a design disk between the illuminating means and a user of the nightlight; and means for rotating the design disk. The energizing means may be either a direct current (DC) power source or means for connecting the nightlight to an alternating current (AC) power source.

In another aspect, the present invention is directed to a nightlight that includes a casing having an aperture in a front side thereof; a plug that extends from a rear side of the casing and connects the nightlight to an AC power source; and a light bulb that is illuminated by the AC power source and provides illumination through the aperture in the front side of the casing. The nightlight also includes an electric motor mounted in the casing that receives power from the AC power source and has a shaft that extends through the front side of the casing proximate to the aperture illuminated by the light bulb. The nightlight also includes a transparent or translucent design disk that mounts on the shaft and rotates with the shaft when the motor is powered by the AC power source. The design disk has a diameter that causes the disk to cover the aperture in the front side of the casing when the disk is mounted on the shaft. The design disk has a design thereon that is visible when viewed from the front side of the nightlight when the light bulb shines through the disk from the opening in the front side of the casing.

In yet another aspect, the present invention is directed to a nightlight that includes a casing having a front side and a rear side; a plug that extends from the rear side of the casing and connects the nightlight to an AC power source; and a light bulb within the casing that is illuminated by the AC power source. The nightlight also includes an illumination area on the front side of the casing from which illumination from the light bulb is radiated; and an electric motor mounted in the casing that receives power from the AC power source. The motor has a shaft that extends through the front side of the casing proximate to the illumination area. The nightlight also includes a design disk that mounts on the shaft and rotates with the shaft when the motor is powered by the AC power source. The design disk has a diameter that causes the disk to cover the illumination area when the disk is mounted on the shaft. The design disk has a design thereon that is visible when viewed from the front side of the nightlight when the light bulb shines through the disk from the illumination area on the front side of the casing.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
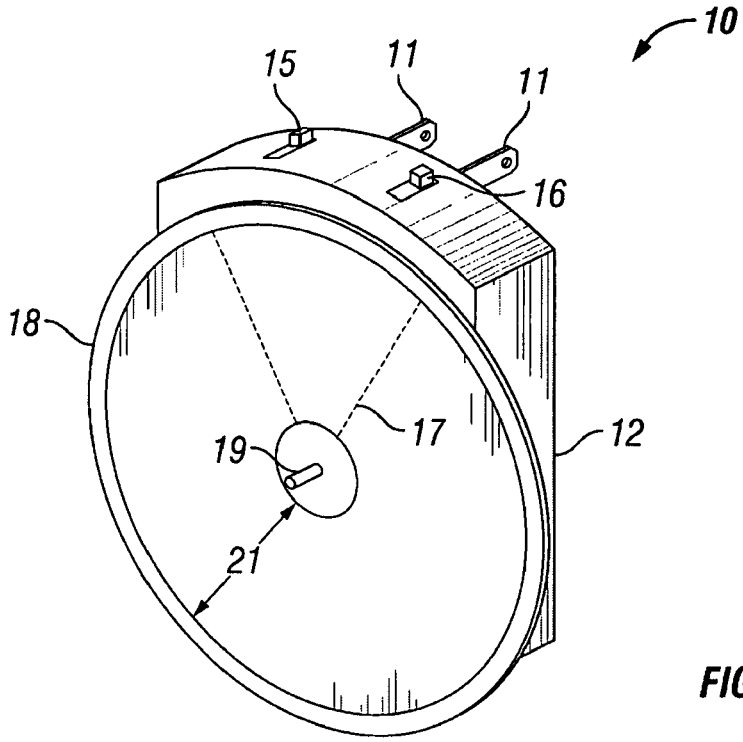
FIG. 1 is a perspective view of a first embodiment of the nightlight of the present invention.

FIG. 1 is a perspective view of a first embodiment of the nightlight 10 of the present invention. For power, the nightlight plugs into any standard alternating current (AC) electrical outlet using prongs 11. A casing 12 encloses an electronic circuit 20 (see FIG. 3), which powers a light bulb 13 and, optionally, an electric motor 14. Separate switches 15 and 16 on top of the casing enable a user to turn on the light and the electric motor.

The light bulb 13 shines through a generally trapezoidal area 17 within the top half of the casing 12. The area may be an aperture in the casing, or a transparent or translucent portion of the casing that allows light from the light bulb to provide illumination from the front side of the casing. An interchangeable transparent or translucent design disk 18 removably mounts on a shaft 19, which extends through the casing from the electric motor 14 therein. The height of the shaft, in relation to the lighted area 17, is selected so that the design area 21 of the disk passes in front of the lighted area as the disk rotates on the shaft.

Figure 2:
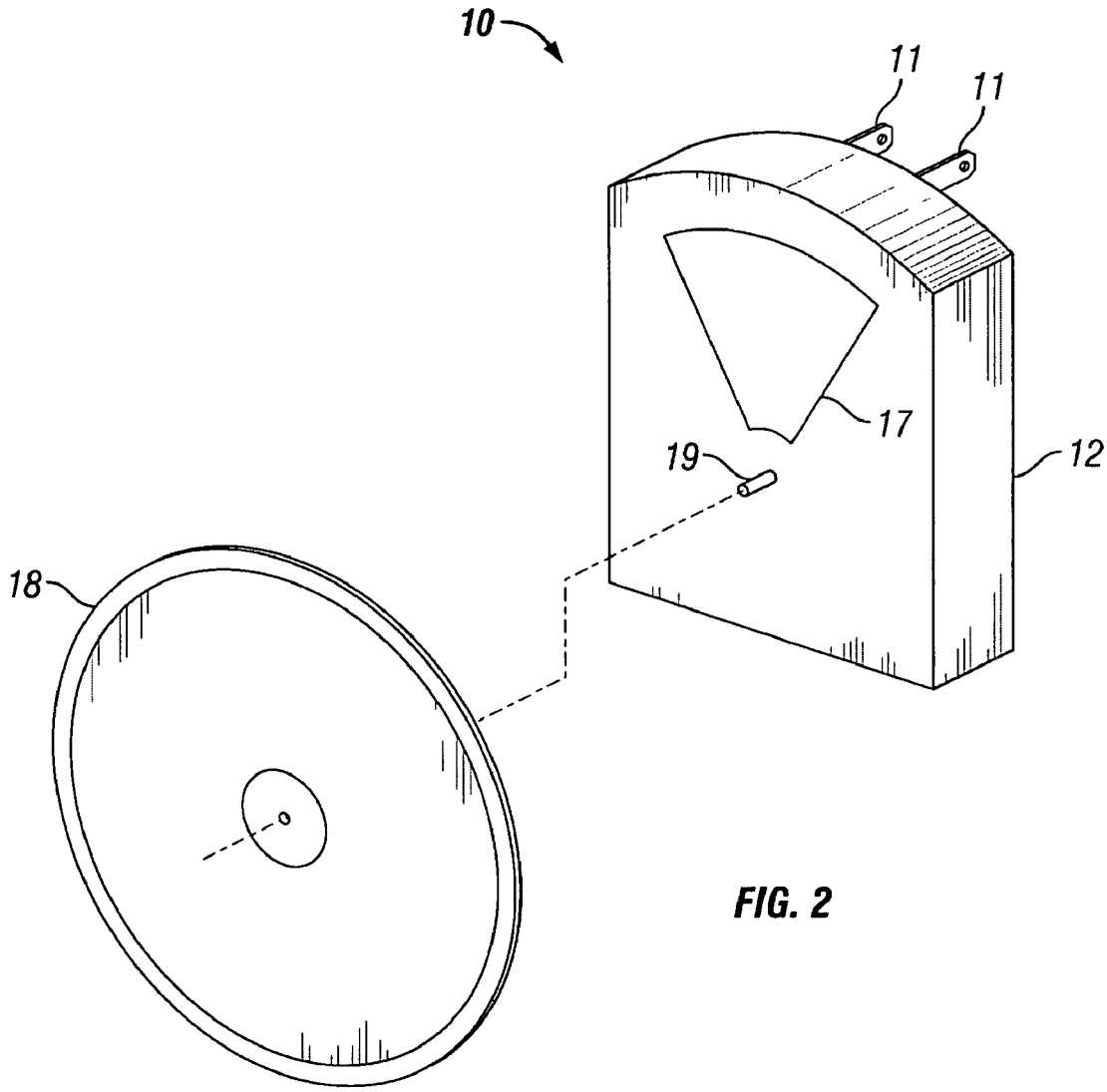
FIG. 2 is an exploded perspective view of the nightlight of FIG. 1A with the interchangeable rotating design disk removed.

FIG. 2 is an exploded perspective view of the nightlight 10 with the interchangeable rotating design disk 18 removed from the shaft 19. By simply slipping a disk onto or off of the shaft, a new design can be illuminated by the lighted area 17.

Figure 3:
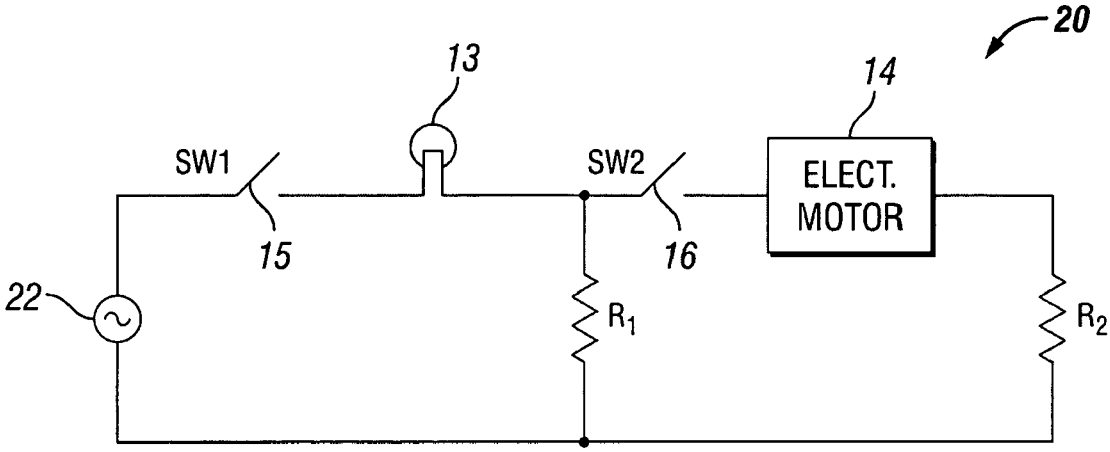
FIG. 3 is an exemplary electrical circuit suitable for use in the nightlight of the present invention.

FIG. 3 is an exemplary electrical circuit 20 suitable for use in the nightlight of the present invention. An AC power source 22 is connected to the light bulb 13 when switch (SW1) 15 is closed. If switch (SW2) 16 is also closed, the AC power source is also connected to the electric motor 14. The electric motor may be an AC motor, or may be a direct current (DC) motor with an internal or external AC-to-DC converter. Resistors R1 and R2 balance the load between the light bulb and the electric motor. Optionally, switch (SW2) 16 may be replaced by a rheostat that adjustably controls the current supplied to the electric motor. In this way, the user can control the speed at which the design disk rotates.

In another embodiment, the power source is a direct current (DC) power source such as a battery. The electric motor 14 in this embodiment is a DC motor. With this embodiment, the nightlight does not have to be plugged in to a wall outlet. Instead, the nightlight may be placed on any suitable surface such as a dresser or a bedside table. Legs may be provide to raise the casing to a sufficient height for the design disk to clear the surface of the dresser or table.

By closing only switch (SW1) 15, a user can illuminate the light bulb 13 of the nightlight without rotating the disk 18, or without even mounting the disk, if a plain white light is preferred. Closing both switches 15 and 16 causes the light bulb to be illuminated and the disk to rotate in front of the lighted area 17.

Figure 4A:
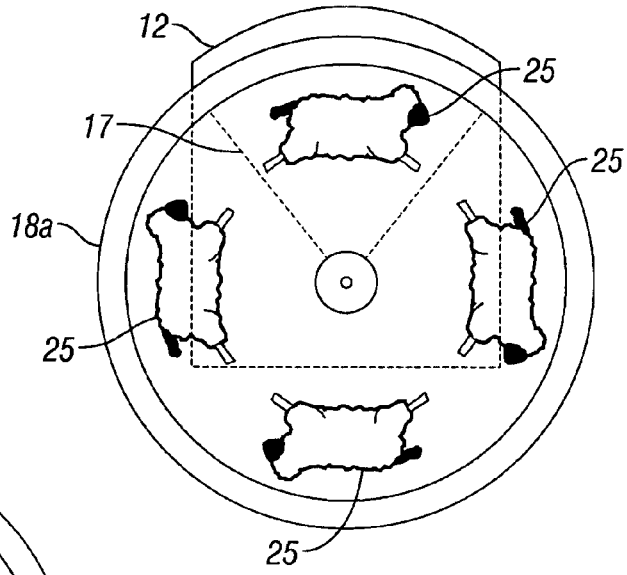
FIGS. 4A–4C are front views of three exemplary design disks suitable for use with the nightlight of the present invention.
Figure 4B:
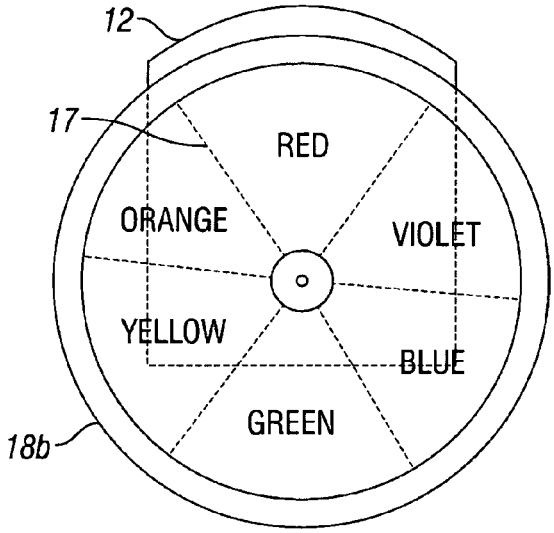
Figure 4C:
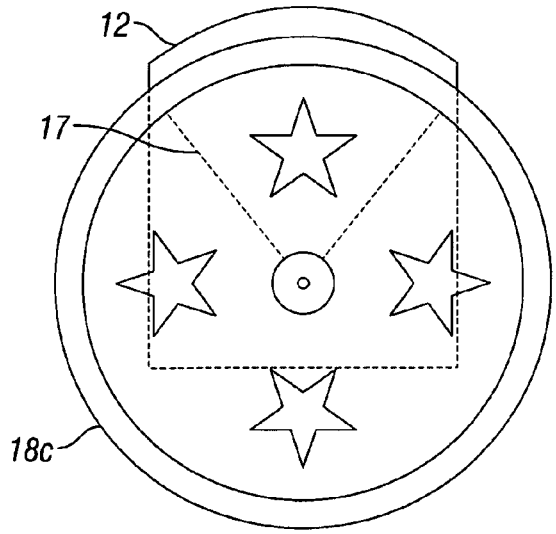

FIGS. 4A–4C are front views of three exemplary design disks 18*a*–18*c* suitable for use with the nightlight of the present invention. Although only three designs are shown, many more designs could be used with the present invention. FIG. 4A illustrates a first design disk 18*a* in which sheep 25 are seen to be jumping through the lighted area 17 as the disk rotates. In other similar designs, the user's favorite breed of dog, cat, horse, and the like may be illustrated. FIG. 4B illustrates a design disk 18*b* that changes colors as it rotates. In the example illustrated, the disk passes the colors of the rainbow in front of the lighted area as the disk rotates. FIG. 4C illustrates a design disk 18*c* that rotates an object of interest to the user in front of the lighted area. In the example illustrated, the disk passes the design of a sports team in front of the lighted area as the disk rotates. The design could also be, for example, nature scenes, cartoon characters, sports stars, movie stars, or any other subject of interest.

It is thus believed that the operation and construction of the present invention will be apparent from the foregoing description. While the multi-sectioned container shown and described has been characterized as being preferred, it will be readily apparent that various changes and modifications could be made therein without departing from the scope of the invention as defined in the following claims.

What is claimed is:

1. A nightlight comprising:

a casing having an aperture in a front side thereof;

a plug that extends from a rear side of the casing and connects the nightlight to an alternating current (AC) power source;

a light bulb that is illuminated by the AC power source and provides illumination through the aperture in the front side of the casing;

an electric motor mounted in the casing, said motor having a shaft that extends through the front side of the casing proximate to the aperture illuminated by the light bulb; and a design disk that mounts on the shaft and rotates with the shaft, said design disk having a radius that causes a portion of the disk to cover the lighted aperture in the front side of the casing when the disk is mounted on the shaft, said rotating design disk having a design thereon, wherein at any one time, a portion of the design that is in front of the lighted aperture is visible when the rotating design disk is viewed from the front side of the nightlight.

2. The nightlight of claim 1, further comprising a first switch that selectively connects the AC power source to the light bulb independently of the electric motor.

3. The nightlight of claim 2, further comprising a second switch that selectively connects the AC power source to the electric motor.

4. The nightlight of claim 3, further comprising a plurality of resistors that balance the load between the light bulb and the electric motor.

5. The nightlight of claim 1, further comprising a rheostat connected to the electric motor that variably controls the speed at which the motor rotates the shaft.

6. The nightlight of claim 1, wherein the electric motor is an AC motor.

7. The nightlight of claim 1, wherein the electric motor is a direct current (DC) motor, and the nightlight further comprises an AC-to-DC converter that converts the AC power source to a DC power source before applying the power to the DC motor.

8. The nightlight of claim 1, wherein the design disk is transparent.

9. The nightlight of claim 1, wherein the design disk is translucent.

10. A nightlight comprising:

a casing having a front side and a rear side;

a plug that extends from the rear side of the casing and connects the nightlight to an alternating current (AC) power source;

a light bulb within the casing that is illuminated by the AC power source;

an illumination area on the front side of the casing from which illumination from the light bulb is radiated;

an electric motor mounted in the casing that receives power from the AC power source, said motor having a shaft that extends through the front side of the casing proximate to the illumination area; and a design disk that mounts on the shaft and rotates with the shaft when the motor is powered by the AC power source, said design disk having a radius that causes a portion of the rotating disk smaller than approximately one-half of the disk to cover the illumination area when the disk is mounted on the shaft, said rotating design disk having a design thereon that moves through the illumination area as the rotating design disk rotates.

11. The nightlight of claim 10, wherein the illumination area is a translucent portion of the front surface of the casing.

12. The nightlight of claim 10, further comprising a rheostat connected to the electric motor that variably controls the speed at which the motor rotates the shaft.

13. A nightlight comprising:

means for illuminating an illumination area on a front surface of the nightlight;

means for energizing the illuminating means; and means for interposing and rotating a rotating design disk between the illumination area and a user of the nightlight, said rotating design disk having a design thereon and a center of rotation, said interposing and rotating means including a motor shaft protruding through the front surface of the nightlight proximate to the illumination area; and wherein the interposing means positions the rotating design disk in a position in which the center of rotation is offset from the illumination area, thereby causing a portion of the rotating design disk on one side of the center of rotation to cover the illumination area, and causing different portions of the design to move through the illumination area as the rotating design disk rotates.

14. The nightlight of claim 13, wherein the energizing means is a battery.

15. The nightlight of claim 14, wherein the rotating means is a direct current (DC) electric motor.

16. The nightlight of claim 13, wherein the energizing means is a plug that connects the nightlight to an alternating current (AC) power source.

17. The nightlight of claim 16, wherein the rotating means is an AC electric motor.

18. The nightlight of claim 13, further comprising means for variably controlling the speed of rotation of the rotating means.

* * * * *